US007808512B1

(12) United States Patent
Hutchins et al.

(10) Patent No.: US 7,808,512 B1
(45) Date of Patent: Oct. 5, 2010

(54) BOUNDING REGION ACCUMULATION FOR GRAPHICS RENDERING

(75) Inventors: Edward A. Hutchins, Mountain View, CA (US); Christopher D. S. Donham, San Mateo, CA (US); Gary C. King, San Jose, CA (US); Michael J. M. Toksvig, Palo Alto, CA (US); Mark J. Kilgard, Austin, TX (US)

(73) Assignee: NVIDIA Corporation, Santa Clara, CA (US)

( * ) Notice: Subject to any disclaimer, the term of this patent is extended or adjusted under 35 U.S.C. 154(b) by 571 days.

(21) Appl. No.: 11/642,276

(22) Filed: Dec. 19, 2006

(51) Int. Cl.
*G09G 5/00* (2006.01)

(52) U.S. Cl. ..... 345/620

(58) Field of Classification Search ..... 345/620
See application file for complete search history.

(56) References Cited

U.S. PATENT DOCUMENTS

| | | | | |
|---|---|---|---|---|
| 5,010,515 | A * | 4/1991 | Torborg, Jr. | 345/505 |
| 5,313,287 | A | 5/1994 | Barton | |
| 5,452,104 | A | 9/1995 | Lee | |
| 6,501,564 | B1 | 12/2002 | Schramm et al. | |
| 6,744,433 | B1 | 6/2004 | Bastos et al. | |
| 6,956,579 | B1 | 10/2005 | Diard et al. | |
| 6,989,840 | B1 | 1/2006 | Everitt et al. | |
| 7,154,066 | B2 | 12/2006 | Talwar et al. | |
| 7,184,040 | B1 | 2/2007 | Tzvetkov | |
| 7,289,119 | B2 * | 10/2007 | Heirich et al. | 345/427 |
| 2001/0005209 | A1 | 6/2001 | Lindholm et al. | |
| 2004/0085313 | A1 | 5/2004 | Moreton et al. | |
| 2005/0225670 | A1 * | 10/2005 | Wexler et al. | 348/441 |
| 2006/0245001 | A1 | 11/2006 | Lee et al. | |
| 2006/0267981 | A1 | 11/2006 | Naoi | |
| 2006/0274070 | A1 * | 12/2006 | Herman et al. | 345/474 |
| 2008/0118148 | A1 * | 5/2008 | Jiao et al. | 382/173 |

* cited by examiner

*Primary Examiner*—Aaron M Richer

(57) ABSTRACT

In a raster unit of a graphics processor, a method for bounding region accumulation for graphics rendering. The method includes receiving a plurality of graphics primitives for rasterization in a raster stage of a graphics processor and rasterizing the graphics primitives to generate a plurality pixels related to the graphics primitives and a plurality of respective bounding regions related to the graphics primitives. Upon receiving an accumulation start command, the bounding regions are accumulated in an accumulation register. The accumulation continues until an accumulation stop command is received. The operation results in an accumulated bounding region. Access to the accumulated bounding region is enabled to facilitate a subsequent graphics rendering operation.

22 Claims, 8 Drawing Sheets

BOUNDING REGION ACCUMULATION FOR GRAPHICS RENDERING

FIELD OF THE INVENTION

The present invention is generally related to hardware accelerated graphics computer systems.

BACKGROUND OF THE INVENTION

Recent advances in computer performance have enabled graphic systems to provide more realistic graphical images using personal computers, home video game computers, handheld devices, and the like. In such graphic systems, a number of procedures are executed to "render" or draw graphic primitives to the screen of the system. A "graphic primitive" is a basic component of a graphic picture, such as a point, line, polygon, or the like. Rendered images are formed with combinations of these graphic primitives. Many procedures may be utilized to perform 3-D graphics rendering.

Specialized graphics processing units (e.g., GPUs, etc.) have been developed to optimize the computations required in executing the graphics rendering procedures. The GPUs are configured for high-speed operation and typically incorporate one or more rendering pipelines. Each pipeline includes a number of hardware-based functional units that are optimized for high-speed execution of graphics instructions/data, where the instructions/data are fed into the front end of the pipeline and the computed results emerge at the back end of the pipeline. The hardware-based functional units, cache memories, firmware, and the like, of the GPU are optimized to operate on the low-level graphics primitives (e.g., comprising "points", "lines", "triangles", etc.) and produce real-time rendered 3-D images.

The real-time rendered 3-D images are generated using raster display technology. Raster display technology is widely used in computer graphics systems, and generally refers to the mechanism by which the grid of multiple pixels comprising an image are influenced by the graphics primitives. For each primitive, a typical rasterization system generally steps from pixel to pixel and determines whether or not to "render," or write a given pixel into a frame buffer or pixel map, as per the contribution of the primitive. This, in turn, determines how to write the data to the display buffer representing each pixel.

Various traversal algorithms and various rasterization methods have been developed for computing from a graphics primitive based description to a pixel based description (e.g., rasterizing pixel to pixel per primitive) in a way such that all pixels within the primitives comprising a given 3-D scene are covered. For example, some solutions involve generating the pixels in a unidirectional manner. Such traditional unidirectional solutions involve generating the pixels row-by-row in a constant direction. This requires that the sequence shift across the primitive to a starting location on a first side of the primitive upon finishing at a location on an opposite side of the primitive.

Other traditional methods involve stepping pixels in a local region following a space filling curve such as a Hilbert curve. The coverage for each pixel is evaluated to determine if the pixel is inside the primitive being rasterized. This technique does not have the large shifts (which can cause inefficiency in the system) of the unidirectional solutions, but is typically more complicated to design than the unidirectional solution.

Once the primitives are rasterized into their constituent pixels, these pixels are then processed in pipeline stages subsequent to the rasterization stage where the rendering operations are performed. Typically, these rendering operations involve reading the results of prior rendering for a given pixel from the frame buffer, modifying the results based on the current operation, and writing the new values back to the frame buffer. For example, to determine if a particular pixel is visible, the distance from the pixel to the camera is often used. The distance for the current pixel is compared to the closest previous pixel from the frame buffer, and if the current pixel is visible, then the distance for the current pixel is written to the frame buffer for comparison with future pixels. Similarly, rendering operations that assign a color to a pixel often blend the color with the color that resulted from previous rendering operations. Generally, rendering operations assign a color to each of the pixels of a display in accordance with the degree of coverage of the primitives comprising a scene. The per pixel color is also determined in accordance with texture map information that is assigned to the primitives, lighting information, and the like.

A problem exists however with the ability of prior art 3-D rendering architectures to scale to handle the increasingly complex 3-D scenes of today's applications. Many of these applications require the ability to efficiently implement complex screen coloring and rendering effects in real-time, such as, for example, complex OpenVG (Open Vector Graphics) screen effects. Additional applications require the ability to accurately draw complex objects or characters in real-time whether the character will ultimately result on screen or not, and the ability to accurately simulate "lens flare" type effects for bright light sources.

With computer screens now commonly having screen resolutions of 1920×1200 pixels or larger, traditional methods of increasing 3-D rendering performance to handle increasingly demanding applications are problematic. For example, increasing clock speed to improve performance has negative side effects, such as increasing power consumption and increasing the heat produced by the GPU integrated circuit die. Other methods for increasing performance, such as incorporating large numbers of parallel execution units for parallel execution of GPU operations have negative side effects such as increasing integrated circuit die size, decreasing yield of the GPU manufacturing process, increasing power requirements, and the like.

Thus, a need exists for a rasterization process that can scale as graphics application needs require and provide added performance without incurring penalties such as increased power consumption and/or reduced fabrication yield.

SUMMARY OF THE INVENTION

Embodiments of the present invention provide a method and system for a rasterization process that can scale as graphics application needs require and provide added performance without incurring penalties such as increased power consumption and/or reduced fabrication yield.

In one embodiment, the present invention is implemented as a method for bounding region accumulation for graphics rendering. The method is implemented within a raster unit of a GPU (e.g., graphics processor unit). The method includes receiving a plurality of graphics primitives (e.g., triangles) for rasterization in a raster stage of a graphics processor and rasterizing the primitives to generate a plurality of pixels related to the primitives and a plurality of respective bounding regions related to the primitives. Upon receiving an accumulation start command (e.g., from a graphics driver), the bounding regions are accumulated in an accumulation register coupled within a raster unit of the GPU. The accumulation continues until an accumulation stop command is received. The operation results in an accumulated bounding region. Access to the accumulated bounding region is enabled to facilitate a subsequent graphics rendering operation.

In one embodiment, the accumulated bounding box has a left limit related to a leftmost one of the respective bounding boxes, a right limit related to a rightmost one of the respective bounding boxes, an upper limit related to an uppermost one of the respective bounding boxes, and a lower limit related to a lowermost one of the respective bounding boxes. In one embodiment, the bounding regions are bounding boxes. In one embodiment, an accumulated bounding box can be accessed by the raster unit to perform a scissoring operation on a subsequently received graphics primitive, and the scissoring operation can be configured to implement an OpenVG paint application operation.

In one embodiment, the accumulated bounding box can be accessed by the raster unit to perform a pre-rendering operation on a stream of subsequently received graphics primitives (e.g., primitives comprising a complex character or object). The pre-rendering operation can be used to determine whether the object resulting from the stream of primitives will ultimately appear on a display. In one embodiment, wherein the pre-rendering operation is configured to determine a screen area size of an object resulting from stream of subsequently received graphics primitives. The screen area size can be used to implement a camera lens flare effect on a display.

In this manner, embodiments of the present invention efficiently implement complex screen coloring and rendering effects in real-time, such as, for example, complex OpenVG (Open Vector Graphics) screen effects and "lens flare" type effects for bright light sources. Additionally, embodiments of the present invention can enhance real-time rendering performance by quickly and accurately determining whether complex objects or characters will ultimately be rendered on screen or not, thereby saving valuable computing cycles from being wasted. These attributes facilitate a rasterization process that can scale without resorting to prior art half measures (e.g., clock speed over-increase) which increase power consumption and/or reduce fabrication yield.

BRIEF DESCRIPTION OF THE DRAWINGS

The present invention is illustrated by way of example, and not by way of limitation, in the figures of the accompanying drawings and in which like reference numerals refer to similar elements.

DETAILED DESCRIPTION OF THE INVENTION

Figure 1:
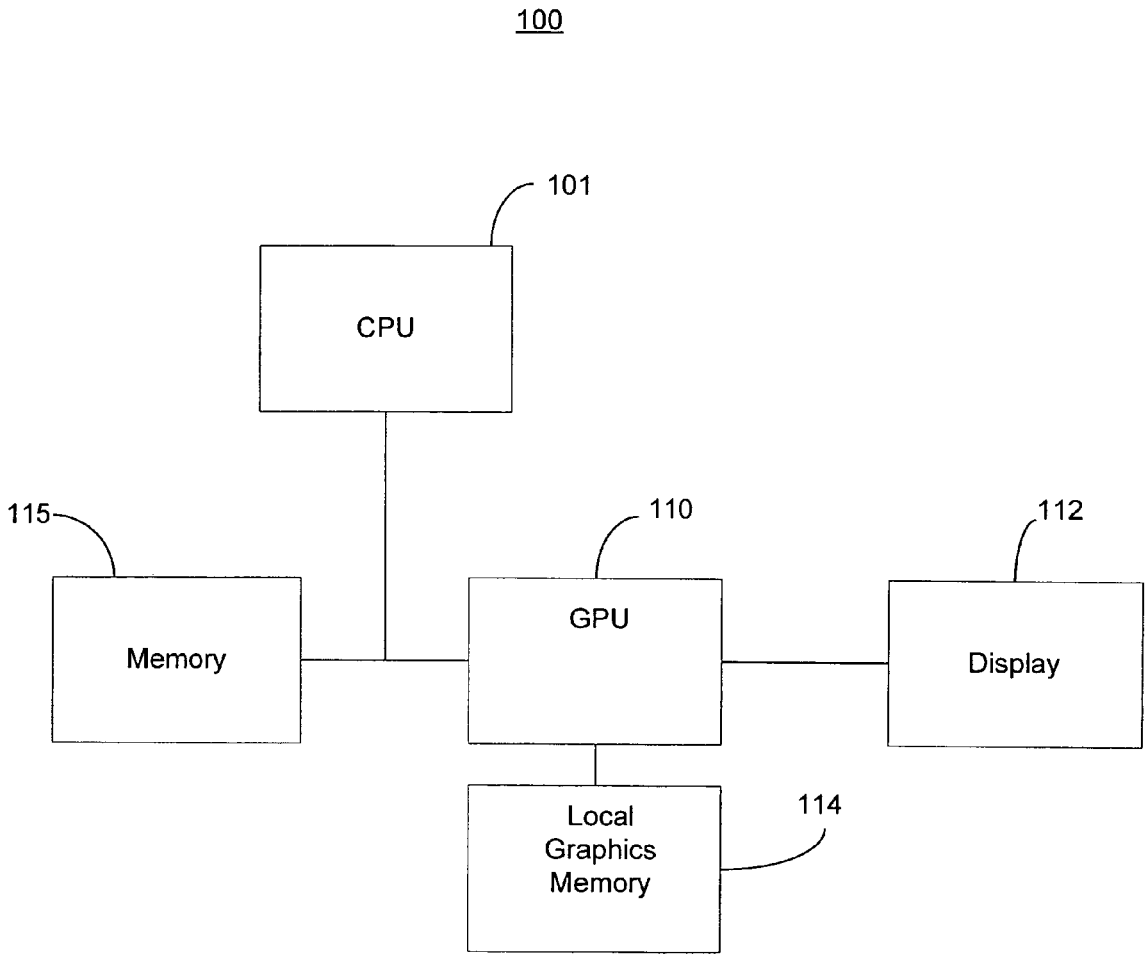
FIG. 1 shows a computer system in accordance with one embodiment of the present invention.

Reference will now be made in detail to the preferred embodiments of the present invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of embodiments of the present invention, numerous specific details are set forth in order to provide a thorough understanding of the present invention. However, it will be recognized by one of ordinary skill in the art that the present invention may be practiced without these specific details. In other instances, well-known methods, procedures, components, and circuits have not been described in detail as not to unnecessarily obscure aspects of the embodiments of the present invention.

Notation and Nomenclature:

Some portions of the detailed descriptions, which follow, are presented in terms of procedures, steps, logic blocks, processing, and other symbolic representations of operations on data bits within a computer memory. These descriptions and representations are the means used by those skilled in the data processing arts to most effectively convey the substance of their work to others skilled in the art. A procedure, computer executed step, logic block, process, etc., is here, and generally, conceived to be a self-consistent sequence of steps or instructions leading to a desired result. The steps are those requiring physical manipulations of physical quantities. Usually, though not necessarily, these quantities take the form of electrical or magnetic signals capable of being stored, transferred, combined, compared, and otherwise manipulated in a computer system. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussions, it is appreciated that throughout the present invention, discussions utilizing terms such as "processing" or "accessing" or "executing" or "storing" or "rendering" or the like, refer to the action and processes of a computer system (e.g., computer system 100 of FIG. 1), or similar electronic computing device, that half manipulates and transforms data represented as physical (electronic) quantities within the computer system's registers and memories into other data similarly represented as physical quantities within the computer system memories or registers or other such information storage, transmission or display devices.

Computer System Platform:

FIG. 1 shows a computer system 100 in accordance with one embodiment of the present invention. Computer system 100 depicts the components of a basic computer system in accordance with embodiments of the present invention providing the execution platform for certain hardware-based and software-based functionality. In general, computer system 100 comprises at least one CPU 101, a system memory 115, and at least one graphics processor unit (GPU) 110. The CPU 101 can be coupled to the system memory 115 via a bridge component/memory controller (not shown) or can be directly coupled to the system memory 115 via a memory controller (not shown) internal to the CPU 101. The GPU 110 is coupled to a display 112. One or more additional GPUs can optionally be coupled to system 100 to further increase its computational power. The GPU(s) 110 is coupled to the CPU 101 and the system memory 115. System 100 can be implemented as, for example, a desktop computer system or server computer system, having a powerful general-purpose CPU 101 coupled to a dedicated graphics rendering GPU 110. In such an embodiment, components can be included that add peripheral buses, specialized graphics memory, IO devices, and the like. Similarly, system 100 can be implemented as a handheld device (e.g., cellphone, etc.) or a set-top video game console device such as, for example, the Xbox®, available from Microsoft Corporation of Redmond, Wash., or the PlayStation3®, available from Sony Computer Entertainment Corporation of Tokyo, Japan.

It should be appreciated that the GPU 110 can be implemented as a discrete component, a discrete graphics card designed to couple to the computer system 100 via a connector (e.g., AGP slot, PCI-Express slot, etc.), a discrete integrated circuit die (e.g., mounted directly on a motherboard), or as an integrated GPU included within the integrated circuit die of a computer system chipset component (not shown). Additionally, a local graphics memory 114 can be included for the GPU 110 for high bandwidth graphics data storage.

EMBODIMENTS OF THE INVENTION

Embodiments of the present invention implement a method and system for bounding box accumulation for graphics rendering. The method is implemented within a raster unit of a GPU (e.g., GPU 110). The method includes receiving a plurality of graphics primitives (e.g., triangles) for rasterization in a raster unit of a GPU and rasterizing the graphics primitives to generate a plurality of pixels related to the graphics primitives and a plurality of respective bounding boxes related to the graphics primitives. Upon receiving an accumulation start command (e.g., from a graphics driver executing on the CPU 101), the bounding boxes are accumulated in an accumulation register coupled within the raster unit. The accumulation continues until an accumulation stop command is received (e.g., from the graphics driver). The operation results in the production of an accumulated bounding box that bounds the region occupied by all of the primitives received between the start command in the stop command. Access to the accumulated bounding box is enabled to facilitate a subsequent graphics rendering operation. Embodiments of the present invention and their benefits are further described below.

Figure 2:
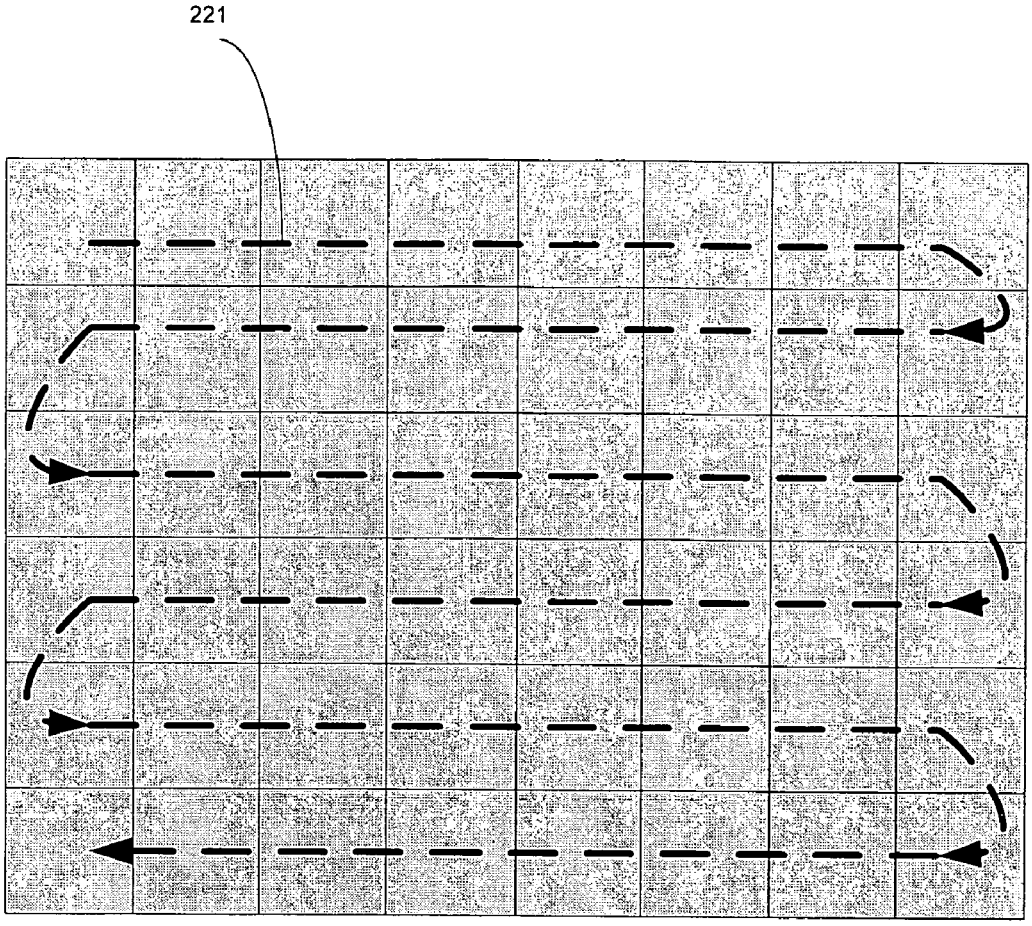
FIG. 2 shows a diagram depicting a grid of pixels being rasterized in a boustrophedonic pattern in accordance with one embodiment of the present invention.

FIG. 2 shows a diagram depicting a grid of pixels being rasterized in a boustrophedonic pattern in accordance with one embodiment of the present invention.

In one embodiment, as depicted in FIG. 2, a raster stage of the GPU 110 utilizes a boustrophedonic pattern for traversing a graphics primitive. As depicted in FIG. 2, the boustrophedonic pattern is indicated by the dotted line 221. In such an embodiment, each pixel of the grid of pixels is traversed in the order indicated by the line 221. The line 221 shows a boustrophedonic pattern of traversal, where the term "boustrophedonic" refers to a traversal pattern which visits all pixels on a 2D area by scanning back and forth along one axis as each pass moves farther along on the orthogonal axis, much as a farmer would plow or mow a field. The term boustrophedonic generally means "as the oxen plows" as in, for example, a field.

Thus, as depicted in FIG. 2, this boustrophedonic rasterization refers to a serpentine pattern that folds back and forth along a predominant axis. In the FIG. 2 example, the predominant axis is horizontal. A horizontal boustrophedonic sequence, for example, may generate all the pixels within a primitive triangle that are on one row from left to right, and then generate the next row right to left, and so on. Such a folded path ensures that an average distance from a generated pixel to recently previously generated pixels is relatively small. Additionally, it should be noted that the boustrophedonic traversal pattern can be implemented on a tile-by-tile basis (e.g., from a generated tile to a recently previously generated tile) as opposed to a pixel-by-pixel basis.

The boustrophedonic pattern has advantages for maintaining a cache of relevant data and reducing the memory requests required for frame buffer and texture access. For example, generating pixels that are near recently generated pixels is important when recent groups of pixels and/or their corresponding texture values are kept in memories of a limited size (e.g., cache memories, etc.). Additional details regarding boustrophedonic pattern rasterization can be found in U.S. Patent Application "A GPU HAVING RASTER COMPONENTS CONFIGURED FOR USING NESTED BOUSTROPHEDONIC PATTERNS TO TRAVERSE SCREEN AREAS" by Franklin C. Crow et al., Ser. No. 11/304,904, filed on Dec. 15, 2005, which is incorporated herein in its entirety.

It should be noted that although embodiments of the present invention are described in the context of boustrophedonic rasterization, other types of rasterization patterns can be used. For example, the algorithms and GPU stages described herein for rasterizing tile groups can be readily applied to traditional left-to-right, line-by-line rasterization patterns.

Figure 3:
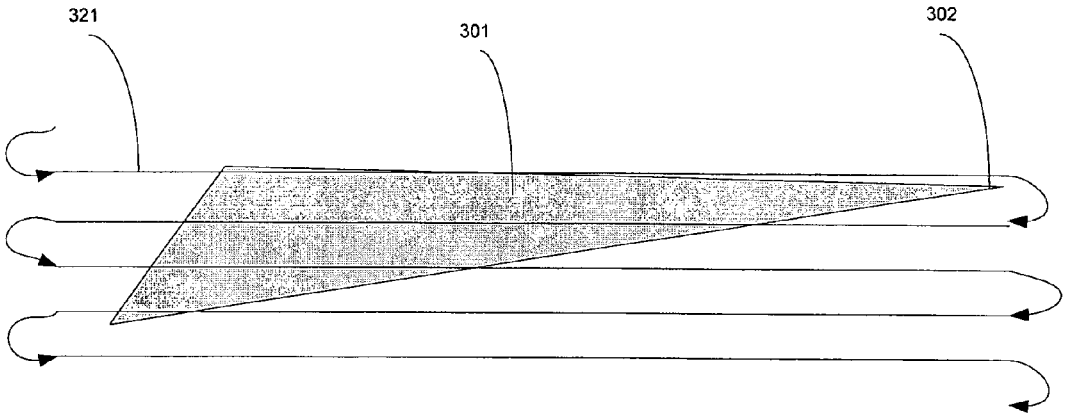
FIG. 3 shows a diagram of a triangle polygon against a rasterization pattern for a raster unit of a GPU in accordance with one embodiment of the present invention.

FIG. 3 shows a diagram of a triangle polygon 301 (e.g., triangle 301) against a rasterization traversal pattern 321 for a raster unit of the GPU 110 in accordance with one embodiment of the present invention. As shown in the FIG. 3 embodiment, a raster unit of the GPU 110 traverses the triangle 301 and stamps out pixels that have at least some coverage with respect to the triangle 301. The resulting pixels are subsequently sent down the graphics pipeline for further processing.

Figure 4:
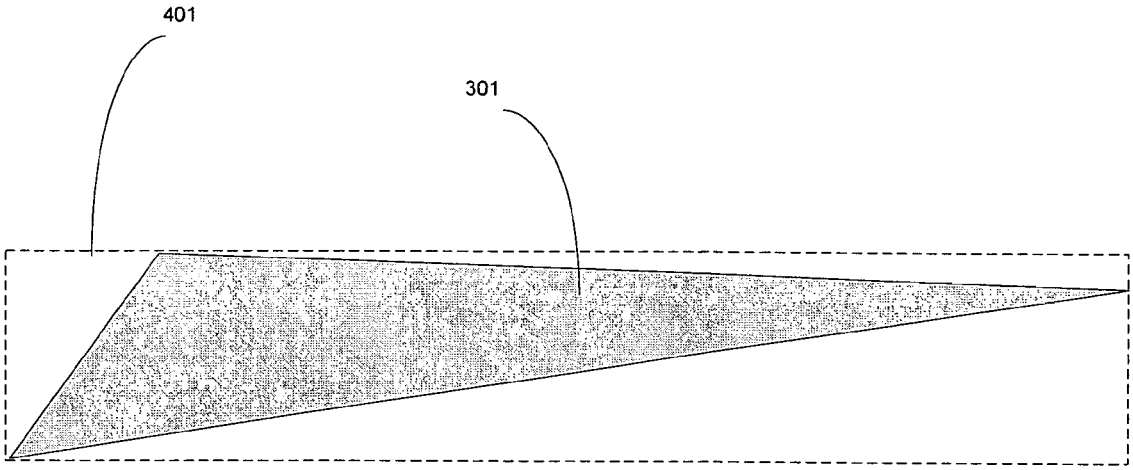
FIG. 4 shows a diagram of a bounding box related to the graphics primitive 301 in accordance with one embodiment of the present invention.

FIG. 4 shows a diagram of a bounding box 401 related to the graphics primitive 301 in accordance with one embodiment of the present invention. As described above, rasterization results in a determination of pixels that are related to the primitive 301. The rasterization process further results in the generation of a bounding box that precisely contains, or bounds, each primitive.

As depicted in FIG. 4, the bounding box 401 is shown with its respective primitive 301. As depicted in FIG. 4, the bounding box 401 precisely bounds its given primitive 301. In other words, the bounding box 401 has a left limit that is defined by a leftmost extent of the primitive 301, and a right limit defined by a rightmost extent of the primitive 301. Similarly, the bounding box 401 has an upper limit defined by an uppermost extent and a lower limit defined by a lowermost extent of the primitive 301.

Figure 5:
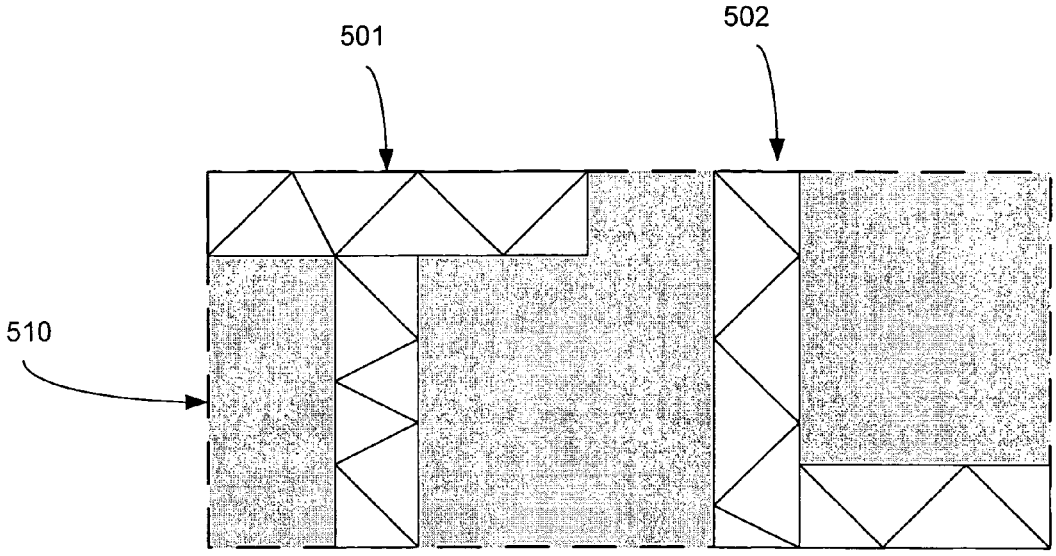
FIG. 5 shows a diagram illustrating an object and an object and a resulting accumulated bounding box in accordance with one embodiment of the present invention.

FIG. 5 shows a diagram illustrating an object 501 and an object 502 and a resulting accumulated bounding box 510 in accordance with one embodiment of the present invention. As depicted in FIG. 5, the objects 501 and 502 are alphanumeric characters (e.g., "T" and "L") that are each comprised of a plurality of constituent primitives (e.g., triangles).

In one embodiment, the present invention utilizes an accumulation start command from a graphics driver executing on the CPU 101 in order to begin accumulating the bounding boxes. Each of the primitives that make up the objects 501 and 502 have their respective corresponding bounding boxes (e.g., bounding box 401) as described above. Additionally, as described above, each bounding box corresponds to the outer limits of its respective primitive. Upon receiving the start accumulating command, the bounding boxes for the primitives comprising the objects 501 and 502 are accumulated by using an accumulation register.

As each of the primitives comprising the objects 501 and 502 is rasterized and processed, the outer limit of the outermost bounding box that is processed is remembered such that the accumulated bounding box 510 is generated. As shown in FIG. 5, this accumulated bounding box 510 has a left limit related to a leftmost one of the respective bounding boxes, a right limit related to a rightmost one of the respective bounding boxes, an upper limit related to an uppermost one of the respective bounding boxes, and a lower limit related to a lowermost one of the respective bounding boxes. Thus, the dimensions of the accumulated bounding box will grow as more and more outlying primitives are processed. The dimensions of the accumulated bounding box remain the same for those primitives that are processed that are within its bounds. When the accumulation stop command is received from the graphics driver, the final dimensions of the accumulated bounding box is set.

In this manner, the accumulated bounding box 510 can be thought of as a bounding box that precisely bounds all of the primitives that have been processed between the accumulation start command and the accumulation stop command. Thus for example, as shown in FIG. 5, the accumulated bounding box 510 precisely bounds the objects 501 and 502. The accumulated bounding box 510 provides a fast and inexpensive way for hardware to report where everything drawn on a screen is located. For example, the hardware of the GPU 110 can quickly and inexpensively provide an accumulated bounding box that will precisely bound all primitives, or only primitives rendered between a start time and a stop time.

In one embodiment, the accumulated bounding box is configured to utilize a depth component in addition to the two-dimensional left-right upper-lower components. For example, in such an embodiment, a three-dimensional accumulated bounding box has a nearest extent and a farthest extent, in addition to rightmost, topmost, leftmost and bottommost extents. The outer boundaries of the three-dimensional accumulated bounding box is built up out of the respective three-dimensional bounding boxes of the primitives rendered between the start time and the stop time. As such, the use and generation of this 3D accumulated bounding box is analogous to the 2D accumulated bounding box described above.

It should be noted that although embodiments of the present invention are described herein with respect to the term "bounding boxes", other regions besides boxes can be used to implement the accumulating functionality described above. Accordingly, the objective would be to accumulate a bounding region within the accumulation register, which could be a number of different polygon types, of which a bounding box is one example. For example, a bounding region employing six points (e.g., hexagon, etc.) as opposed to four points (e.g., square, rectangle, quadrilateral, etc.) can be used to accumulate the bounding regions, bounding boxes, or the like for each of the primitives rendered between the start time and the stop time. Furthermore, an axis-aligned irregular octagon or a coarse bitmap representation (e.g., which is not a polygon) are additional examples that can be used to define the bounding region. Similarly, a 3D accumulated bounding region is not limited to a cubic representation, or the like, and can be, for example, a coarse bitmap representation of irregular shape orientation, or the like. Such implementations are within the scope of the present invention.

Figure 6:
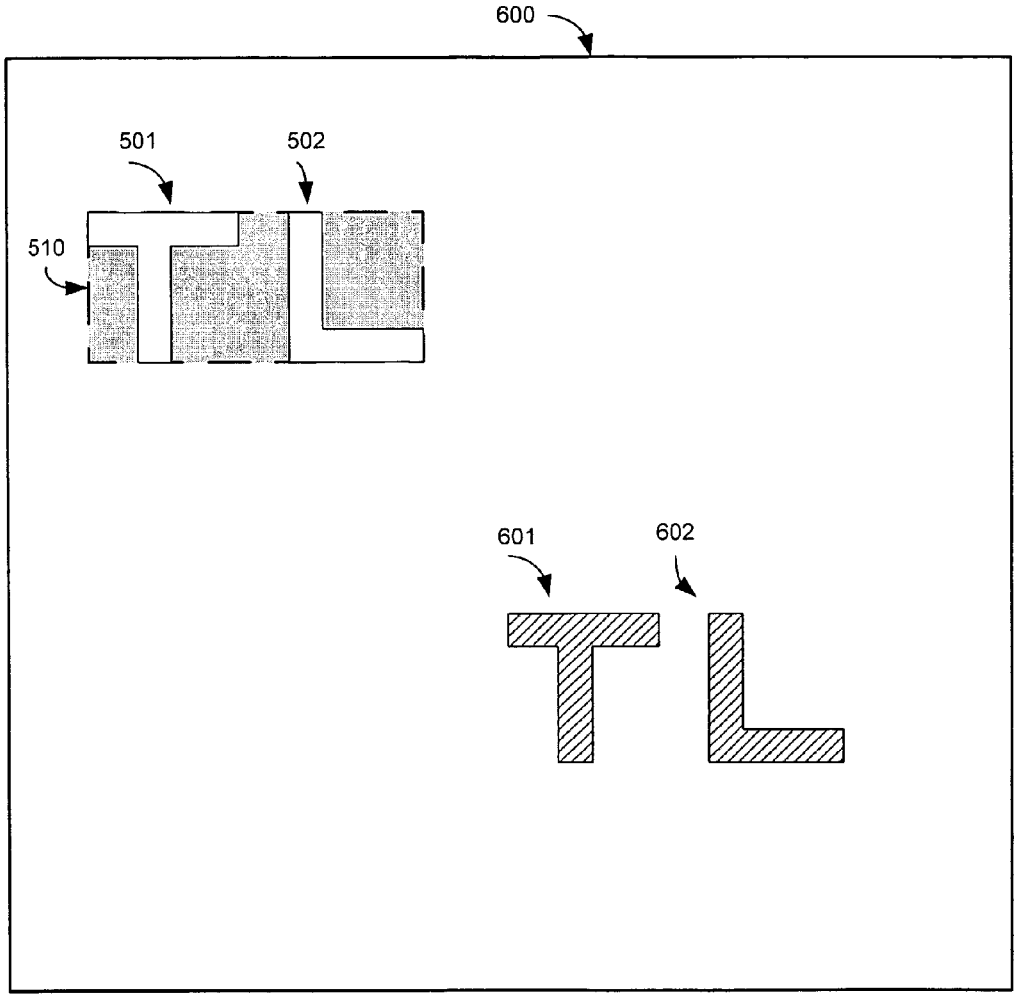
FIG. 6 shows a diagram of a display screen as rendered by a GPU a in accordance with one embodiment of a present invention.

FIG. 6 shows a diagram of a display screen 600 as rendered by the GPU 110 in accordance with one embodiment of a present invention. As depicted in FIG. 6, the display screen 600 shows the bounding box 510 with its associated objects 501 and 502. The display screen 600 also shows two rendered objects 601 and 602.

Embodiments of the present invention enable access to the accumulated bounding box to facilitate one or more subsequent graphics rendering operations. This is illustrated in display screen 600 by the rendered objects 601 and 602. The rendered objects 601 and 602 result from, in this case, an OpenVG paint application operation. In the FIG. 6 embodiment, the paint application operation involves the construction of one or more objects that are used as a stencil for the application of "paint." In a conventional stenciling operation, paint is applied to the entire screen area and only renders on most pixels that are related to the objects. With embodiments of the present invention, the "paint" is only applied to the screen area related to the accumulated bounding box (e.g., accumulated bounding box 510), as opposed to the entire screen. The rendered objects 601 and 602 are shown as finished rendered examples a paint application operation, where in this case, the paint is a crosshatched fill. The accumulated bounding box 510 with the objects 501 and 502 is shown as an example earlier step of the paint operation.

In this manner, embodiments of the present invention provides a quick and efficient way to create a scissor box (e.g., use the accumulated bounding box 510 as a scissor box) to do a "spray paint" application similar to stenciling. The accumulated bounding box 510 prevents rendering of colors into unnecessary screen areas (e.g., outside the stencil). This is very helpful in those applications where it is very expensive to apply colors to a stencil out area. For example, OpenVG is a graphics programming interface that can allow the application of elaborate paints to the stenciled area (e.g., plaids, checkerboard paints, pre-rendered textures, etc.). Such OpenVG painting can be quite expensive in terms of both compute cycles and power consumption when such elaborate paints are applied on a per pixel basis. Since the process can be quite expensive, being able to apply the paint only in the limited scissor box area (e.g., accumulated bounding box 510) saves compute cycles and power. This allows us to apply shader effects into a smaller area (the acutely bounding box) in comparison to the screen area.

Another application of an accumulated bounding box in accordance with embodiments of the present invention, is to use an accumulated bounding box in conjunction with a preview render. A preview render describes a case where one or more complex objects can be quickly rendered at a much lower geometric resolution in order to make intelligent decisions with regard to how the subsequent full resolution rendering is to be handled. In one embodiment, the primitives comprising the one or more complex objects are quickly rendered in rough geometric detail and the corresponding accumulated bounding box is generated. The accumulated bounding box can be quickly examined to determine whether or not the object(s) will actually appear on screen (e.g., whether any of the accumulated bounding box intersects the screen, drawing window, or the like). If the accumulated bounding box shows no intersection with the screen, window, or the like, or shows that the object(s) are depth occluded, the graphics rendering process can completely skip rendering the complex object(s), and consequently save a large number of computer cycles and power expenditure. If the accumulated bounding box shows the complex object(s) will intersect the screen, then the object is rendered in full geometric detail.

Another exemplary application of an accumulated bounding box is to provide a way to determine the on-screen size of a rendered object. An accumulated bounding box for an object can be used to determine how big an object will appear on screen, or how much screen area an object will consume, taking into account any depth occlusion. This can be used to determine how certain rendering effects can be implemented. For example, in a case where a stream of primitives are used to model a bright light source (e.g., like the sun), data regarding the screen area that the light source will consume (e.g., as provided by an accumulated bounding box for the light source) can be used to implement camera lens flare for the light source.

Another exemplary application of an accumulated bounding box is depth peeling. In one embodiment, a 3D accumulated bounding region is used to implement a depth peeling function for a rendered object. In such an implementation, and accumulated 3D bounding region can be used to scissor a stream of primitives being rendered such that primitives that are rendered outside the 3-D bounding region (e.g., primitives nearer than the near limit of the 3D bounding region) can be removed, or peeled away, analogous to the manner in which layers of an onion are peeled away to reveal the underlying visible layer. Accordingly, this functionality is referred to as depth peeling.

Depth peeling is particularly useful in those applications where complex objects are built up of many parts, for example, from a core, to intermediate layer, to an outer layer (e.g., an internal combustion engine, a model of the human body, etc). For example, during an initial rendering of the complex object, the start accumulation and stop accumulation commands can be issued to create a 3D bounding region. This 3D bounding region has depth limits and X Y limits such that the bounding region is smaller than the overall complex object. The 3D bounding region can them be used to scissor a subsequent rendering of the complex object. The scissor operation can remove outer layer from the rendering so that the inner layer is visible (e.g., the engine without the engine block, the human body without the skin, etc.).

Additional details regarding depth peeling and applications thereof can be found in U.S. Pat. No. 6,989,840 "ORDER INDEPENDENT TRANSPARENCY RENDERING SYSTEM AND METHOD", by Everitt et al., and U.S. Pat. No. 6,744,433 "SYSTEM AND METHOD FOR USING AND COLLECTING INFORMATION FROM A PLURALITY OF DEPTH LAYERS", by Bastos et al., which are both incorporated herein in their entirety.

Figure 7:
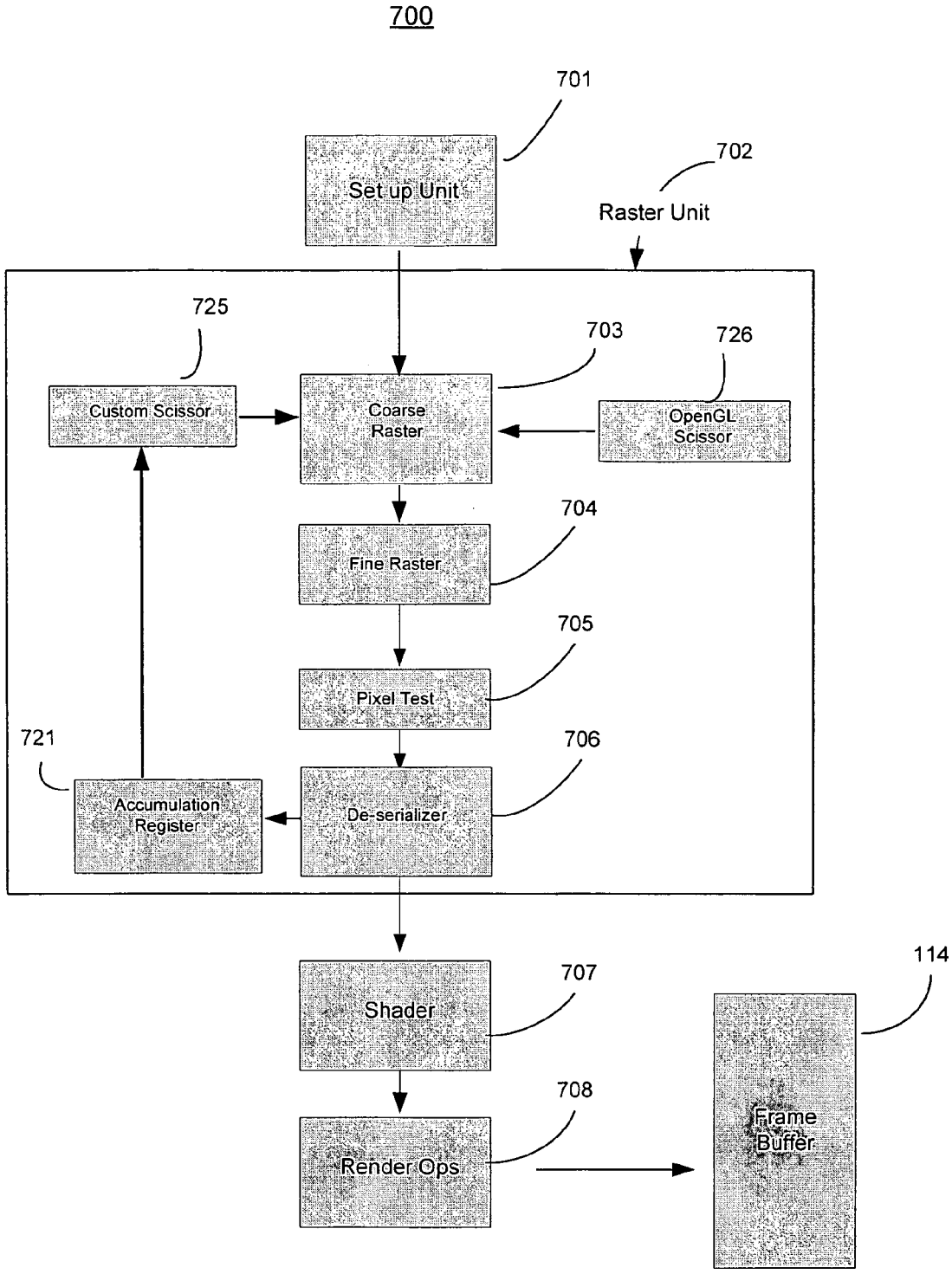
FIG. 7 shows a diagram of an exemplary GPU graphics architecture in accordance with one embodiment of the present invention.

FIG. 7 shows a diagram 700 of an exemplary GPU graphics architecture in accordance with one embodiment of the present invention. As depicted in FIG. 7, diagram 700 shows the components of a GPU (e.g., GPU 110) in accordance with one embodiment of the present invention.

The FIG. 7 embodiment illustrates exemplary internal components 701-726 comprising a pipeline of the GPU 110. As shown in FIG. 7, the GPU 110 includes a setup unit 701 and a rasterizer unit 702. Generally, the set up unit 701 functions by converting primitive descriptions based on vertices to primitive descriptions based on edge descriptions. The rasterizer unit 702 subsequently converts these edge descriptions into filled areas comprising actual pixel descriptions (e.g., pixel areas, pixel sub-samples, etc.). The pixel descriptions are subsequently passed along to other units within the GPU 110 for further processing and rendering.

The raster unit 702 includes a coarse raster component 703 and a fine raster component 704. The coarse raster component 703 implements a coarse rasterization, as it rapidly searches a grid of tiles to identify tiles of interest (e.g., tiles that are covered by a primitive). Each tile comprises a group of pixels (2×2, 4×4, 8×8, 16×16, etc.). The coarse raster searches by these large groups, in contrast to individual pixels, in order to quickly traverse a screen area. Once the tiles of interest are identified, the fine raster component 704 individually identifies the pixels that are covered by the primitive. Hence, in such an embodiment, the coarse raster component 703 rapidly searches a grid of pixels by using tiles, and the fine raster component 704 uses the information generated by the coarse raster component 703 and implements fine granularity rasterization by individually identifying pixels covered by the primitive.

The pixel test component 705 receives the pixels from the fine raster component 704. The pixel test component 705 is configured to determine whether some portion of the primitive being rendered will not be viewed. The pixel test component 705 implements a plurality of pixel test operations which can reduce the scope of the pixel coverage (e.g., reduce the number of pixels turned on by a coverage mask). The pixel test operations include, for example, depth tests, stencil tests, window ID tests, and the like. These pixel tests are implemented to determine whether one or more pixels, or even all of the pixels, related to the primitive will be turned off. The surviving pixels are then transmitted onward to the de-serializer 706. For example, in a case where no pixels related to the primitive survive (e.g., such as when the primitive is completely occluded), those pixels are discarded, and those pixels do not result in any bounding box accumulation for that primitive.

The de-serializer 706 functions by unwinding pixel groups received from the fine raster component 704 in the pixel test component 705 into individual pixels that are then transferred on a one pixel per clock basis to the shader unit 707. The de-serializer 706 also functions as the link to an accumulation register 721 that accumulates the bounding boxes for graphics primitives as described above.

The shader unit 707 performs pixel shader processing for each of the pixels received from the de-serializer 706. The shader unit 507 operates on the pixels in accordance with the parameters iterated across each of the pixels. Once the shader unit 707 completes operation on a pixel, the pixel is transmitted to render operations unit 708. Render operations unit 708 performs back end rendering operations on the pixels received from the shader unit 707, and writes the completed pixels to frame buffer 114.

FIG. 7 also shows a custom scissor register 725 coupled to the accumulation register 721 and the coarse raster unit 703. The scissor register 725 in conjunction with the coarse raster unit 702 together provide the scissoring functionality as described above. The accumulation register 721 is configured to begin accumulating upon receiving a start command from the graphics driver and continue the accumulating until receiving a stop command from the graphics driver. This results in the accumulation register 721 generating an accumulated bounding box in the manner described above. When the stop command is received from the graphics driver, the accumulated bounding box is copied to the scissoring register 725.

It should be noted that in the FIG. 7 embodiment, a separate OpenGL scissoring register 726 is shown. In the FIG. 7 embodiment, the OpenGL scissoring register 726 is used to provide compatibility with the OpenGL scissoring command used by a large number of legacy graphics applications. The OpenGL scissoring register 726 is configured to provide precise adherence with OpenGL scissoring commands expected by the prior legacy OpenGL graphics applications. This frees the custom scissor register 725 to implement high-speed efficient scissoring functionality for advanced uses (e.g., OpenVG applications, pre-rendering, lens flare, etc.) as described above. This allows the hardware of the custom scissoring register 725 to be optimized to provide the advanced functionality without constraints from any legacy OpenGL compliance. The graphics driver includes switching functionality that can intelligently switch between the buffers 725-726 as any particular application would require.

Additionally, it should be noted that although the raster unit 702 is shown with two scissor registers 725 and 726, embodiments of the present invention can be implemented with a single scissor register that would be configured to provide both the custom scissoring functionality as described above and OpenGL compliant scissoring functionality.

Figure 8:
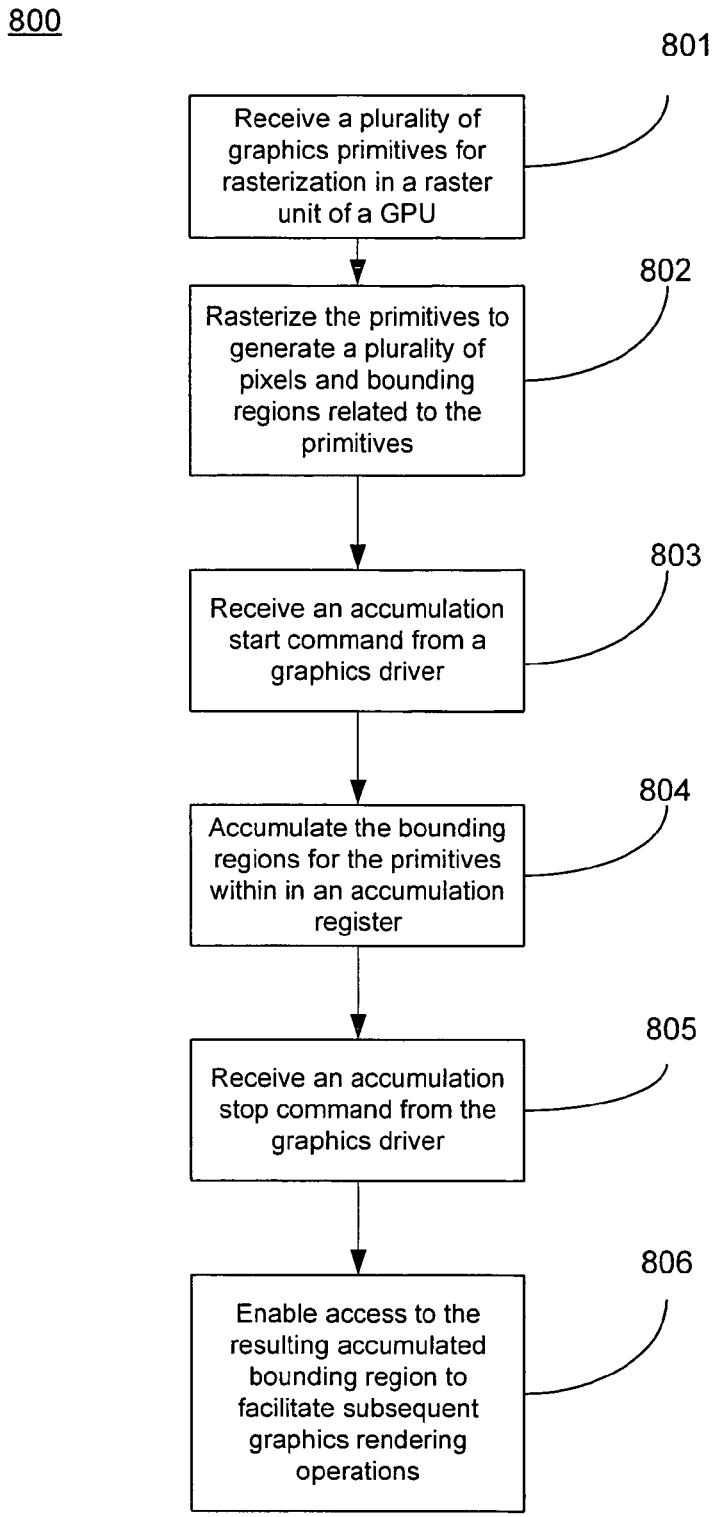
FIG. 8 shows a flowchart of the steps of a bounding region accumulation process in accordance with one embodiment of the present invention.

Referring now to FIG. 8, a flowchart of the steps of a process 800 in accordance with one embodiment of the present invention is shown. As illustrated in FIG. 8, process 800 shows the basic operating steps of a bounding region accumulation process as implemented by a GPU (e.g., GPU 110).

Process 800 begins in step 801, where a raster unit of the GPU (e.g., raster unit 702) receives a plurality of graphics primitives (e.g., triangles) for rasterization. In step 802, the primitives are rasterized to generate a plurality of pixels related to the primitives and a plurality of respective bounding regions related to the primitives. In step 803, an accumulation start command is received from a graphics driver. In step 804, the bounding regions are accumulated in an accumulation register 721 coupled within the raster unit 702 of the GPU 110. In step 805, an accumulation stop command is received from the graphics driver, thus defining the limits of the accumulated bounding region. In step 806, access to the accumulated bounding region is enabled to facilitate one or more subsequent graphics rendering operations, as described above.

The foregoing descriptions of specific embodiments of the present invention have been presented for purposes of illustration and description. They are not intended to be exhaustive or to limit the invention to the precise forms disclosed, and many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. In a raster unit of a graphics processor, a method for bounding region accumulation for graphics rendering, comprising:

receiving a plurality of graphics primitives for rasterization in a raster stage of a graphics processor;

rasterizing the graphics primitives to generate a plurality of pixels related to the graphics primitives and a plurality of respective bounding regions related to the graphics primitives;

upon receiving an accumulation start command, accumulating the bounding regions in an accumulation register and continuing the accumulating until receiving an accumulation stop command, resulting in an accumulated bounding region, wherein the accumulation stop command causes the accumulated bounding region to be transferred to a scissoring register within the raster unit;

enabling access to the accumulated bounding region to facilitate a subsequent graphics rendering operation.

2. The method of claim 1, wherein the accumulated bounding region has a left limit related to a leftmost one of the respective bounding regions, a right limit related to a rightmost one of the respective bounding regions, an upper limit related to an uppermost one of the respective bounding regions, and a lower limit related to a lowermost one of the respective bounding regions.

3. The method of claim 1, wherein the accumulated bounding region is accessed by the raster unit to perform a scissoring operation on a subsequently received graphics primitive.

4. The method of claim 3, wherein the scissoring operation is configured to implement an OpenVG paint application operation.

5. The method of claim 1, wherein the accumulated bounding region is accessed by the raster unit to perform a pre-rendering operation on a stream of subsequently received graphics primitives.

6. The method of claim 5, wherein the pre-rendering operation is configured to determine whether an object resulting from the stream of subsequently received graphics primitives will appear on a display.

7. The method of claim 6, wherein the pre-rendering operation is configured to determine a screen area size of an object resulting from stream of subsequently received graphics primitives.

8. The method of claim 7, wherein the screen area size is used to implement a camera lens flare effect on a display.

9. The method of claim 1, wherein the bounding regions are accumulated by using an accumulation register within the raster unit.

10. A GPU (graphics processor unit), comprising:

a set-up unit for generating polygon descriptions of graphics primitives;

a raster unit coupled to the set-up unit for rasterizing the graphics primitives to generate pixels related to the graphics primitives and respective bounding regions related to the graphics primitives;

an accumulation register for, upon receiving an accumulation start command, accumulating the bounding regions and continuing the accumulating until receiving an accumulation stop command to produce an accumulated bounding region, wherein the accumulation stop command causes the accumulated bounding region to be transferred to a scissoring register within the raster unit, and wherein the accumulation register is configured to enable access to the accumulated bounding region to facilitate a subsequent graphics rendering operation.

11. The GPU of claim 10, wherein the accumulated bounding region has a left limit related to a leftmost one of the respective bounding regions, a right limit related to a rightmost one of the respective bounding regions, an upper limit related to an uppermost one of the respective bounding regions, and a lower limit related to a lowermost one of the respective bounding regions.

12. The GPU of claim 11, wherein the accumulated bounding region is three-dimensional and further includes a nearest limit related to a nearest one of the respective bounding regions, and a farthest limit related to a farthest one of the respective bounding regions.

13. The GPU of claim 10, wherein the accumulated bounding region is accessed by the raster unit to perform a scissoring operation on a subsequently received graphics primitive.

14. The GPU of claim 13, wherein the scissoring operation is configured to implement an OpenVG paint application operation.

15. The GPU of claim 10, wherein the accumulated bounding region is accessed by the raster unit to perform a prerendering operation on a stream of subsequently received graphics primitives.

16. The GPU of claim 10, wherein the scissoring register is a customized scissoring register, and wherein an OpenGL scissoring register is included within the raster unit and is configured to support OpenGL scissoring operations, and wherein a graphics driver includes a switching function for using either the customized scissoring register or the OpenGL scissoring register.

17. The GPU of claim 10, further comprising:

a pixel test component for performing pixel test operations on each of the pixels related to the graphics primitives, and forming the respective bounding regions in accordance with visible pixels passing the pixel test operations, wherein the pixel test operations are configured to determine pixel visibility.

18. The GPU of claim 10, wherein each of the bounding regions comprise bounding boxes.

19. A method for bounding region accumulation, comprising:

receiving a plurality of graphics primitives for rasterization in a processor;

rasterizing the graphics primitives to generate a plurality of pixels related to the graphics primitives;

upon receiving an accumulation start command, accumulating a bounding region in an accumulation register, and continuing the accumulating until receiving an accumulation stop command, resulting in an accumulated bounding region, wherein the accumulation stop command causes the accumulated bounding region to be transferred to a scissoring register within the raster unit;

enabling access to the accumulated bounding region to facilitate a subsequent graphics rendering operation.

20. The method of claim 19, wherein the accumulated bounding region has a left limit related to a leftmost one of the respective bounding regions, a right limit related to a rightmost one of the respective bounding regions, an upper limit related to an uppermost one of the respective bounding regions, and a lower limit related to a lowermost one of the respective bounding regions.

21. The method of claim 20, wherein the accumulated bounding region is three-dimensional and further includes a nearest limit related to a nearest one of the respective bounding regions, and a farthest limit related to a farthest one of the respective bounding regions.

22. The method of claim 21, wherein the accumulated bounding region is used to implement a depth peeling function.

* * * * *